US005152305A

United States Patent [19]

Niv

[11] Patent Number: 5,152,305

[45] Date of Patent: Oct. 6, 1992

[54] APPLICATOR DEVICE

[75] Inventor: Lundy Niv, Manassas, Va.

[73] Assignee: Hair Master, Manassas, Va.

[21] Appl. No.: 759,909

[22] Filed: Sep. 13, 1991

[51] Int. Cl.[5] ..... A45D 24/22; A45D 24/26

[52] U.S. Cl. ..... 132/112; 132/108; 132/116; 222/95; 401/155; 401/161; 401/169; 401/176

[58] Field of Search ..... 401/176, 152, 155, 156, 401/158, 161, 162, 163, 169, 179, 182; 132/108-111, 112-116; 222/95

[56] References Cited

U.S. PATENT DOCUMENTS

| | | | |
|---|---|---|---|
| 1,382,586 | 6/1921 | Wilson | 132/110 |
| 1,417,082 | 5/1922 | McNamara | 401/152 |
| 1,629,389 | 5/1927 | Johnson . | |
| 1,704,959 | 3/1929 | Ames | 132/115 |
| 1,707,655 | 4/1929 | Julien . | |
| 2,148,966 | 2/1939 | Schmidt . | |
| 2,446,398 | 8/1948 | Wilson . | |
| 2,603,223 | 7/1952 | Jefferson . | |
| 2,609,821 | 9/1952 | Weissberger | 132/116 X |
| 3,520,311 | 7/1970 | Iesersek et al. . | |
| 3,683,942 | 8/1972 | McKay . | |
| 3,961,635 | 6/1976 | Miya | 132/113 X |
| 3,964,501 | 6/1976 | Matchett . | |
| 4,399,827 | 8/1983 | Fuhs . | |
| 4,516,591 | 5/1985 | Hierholzer . | |
| 4,566,472 | 1/1986 | Mueller et al. . | |
| 4,605,026 | 8/1986 | Nolin . | |
| 4,691,720 | 9/1987 | Schmitz . | |
| 4,747,420 | 5/1988 | Alaimo . | |
| 4,813,439 | 3/1989 | Morgan . | |
| 4,934,388 | 7/1990 | Gibbs . | |
| 4,993,437 | 2/1991 | Kimura et al. . | |

FOREIGN PATENT DOCUMENTS

| | | | |
|---|---|---|---|
| 697136 | 10/1940 | Fed. Rep. of Germany | 401/176 |
| 393009 | 12/1908 | France | 132/114 |

*Primary Examiner*—Steven A. Bratlie

*Attorney, Agent, or Firm*—Birch, Stewart, Kolasch & Birch

[57] ABSTRACT

An apparatus for a hair dye applicator is provided which includes a hollow tubular housing with screw-threadably removable caps on both longitudinal ends thereof. One of the caps includes a centrally located outlet through which a hollow stem of an integrally formed nozzle unit is fitted. A manually actuable piston is provided within the tubular housing and includes an actuator member longitudinally slidable along the length of and external to the tubular housing. To ensure that the piston does not axially rotate within the tubular housing during a longitudinal sliding motion thereof, a protruding track is longitudinally provided on the inner wall of the tubular housing and mates with a corresponding recess of the piston. A liner such as a disposable plastic bag is provided within the tubular housing above the piston for receiving a hair dispensable product therein. The screw-threaded end caps confine the contents of the applicator during use thereof.

23 Claims, 3 Drawing Sheets

APPLICATOR DEVICE

BACKGROUND OF THE INVENTION

1. Field of the Invention

The present application is directed to an applicator device, and more particularly to an applicator device and method for applying dye to hair.

2. Description of Related Art

There have previously been known in the art devices such as "fountain combs" for applying solutions and the like to hair. These fountain combs generally consist of a hollow shaft into which an applied material is housed and a comb portion having apertures between the comb teeth through which the applied material is expelled. However, prior to the present invention, fountain combs and the like have been difficult to operate with one hand regardless of the dexterity or handedness of the operator and have been crudely assembled such that any applicator nozzle thereof expels an uncontrolled flow of material.

SUMMARY OF THE INVENTION

The present invention overcomes the above problems found in the art by providing a hair dye applicator which is easily operated with a single hand to manually expel a controlled rate of flow of hair dye or the like from an applicator nozzle.

Further, the present invention allows for complete disassembly for cleaning purposes and includes at least a disposable plastic liner therein for receiving dye material.

Still further, the present invention allows for partial disassembly of a nozzle portion thereof in order to orient the applicator nozzle to accommodate the right or left handedness of the operator.

In addition, the hair dye applicator of the present invention is conveniently and easily operable even by an operator with small hands and avoids axial slippage of the piston member therein during use.

More specifically, the present invention provides an applicator comprising: a hollow tubular sleeve member having screw-threads on opposing open ends thereof;

an end cap threadably attachable to a first end of said sleeve member;

a discharge nozzle threadably attachable to a second end of said sleeve member;

a collapsible material receptacle removably fit within said sleeve member adjacent the second end thereof; and a piston member slidable within said sleeve member;

wherein said piston member is manually actuable for compression against said material receptacle thereby extruding the contents of said material receptacle to said discharge nozzle;

said sleeve member including a longitudinally formed slot extending from the first end thereof to a position adjacent the second end of said sleeve member and a longitudinal protrusion formed on an inner surface thereof spaced a predetermined distance apart from said slot, and said piston member including an actuator member formed on an outer peripheral surface thereof and a longitudinal channel formed on the outer surface thereof such that said actuator member and said channel of said piston member mate, respectively, with said longitudinal slot and said longitudinal protrusion of said sleeve member, thereby avoiding twisting of said piston within said sleeve member upon manually sliding said piston member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
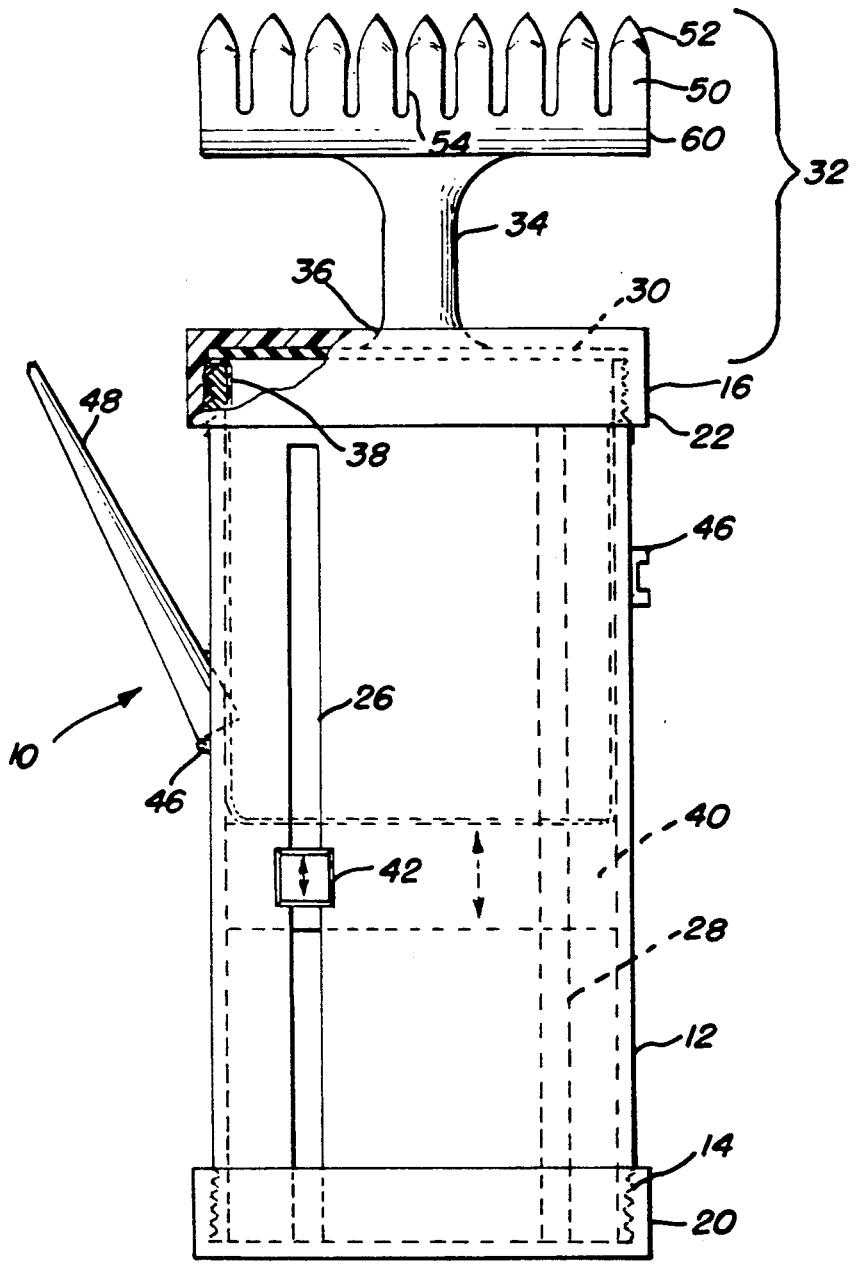
FIG. 1 is a front view of a hair dye applicator according to the present invention.

Referring generally to FIGS. 1 and 2, there is shown an applicator device 10, particularly for use in applying dye or tint to hair such that the applied material flows in an even pattern onto the hair with reduced time and effort on the part of an operator.

The applicator device 10 includes a hollow tubular housing or sleeve member 12, preferably formed of a thin shell of see-through plastic or the like to enable the operator to maintain visual contact with the contents of the applicator, thereby visually determining correspondence between a remaining amount of material and a remaining amount of hair to be coated. The tubular sleeve has a first end 14 and a second end 16 provided therewith, each of the first and second ends 14, 16, respectively being machined with screw-threads 18 thereon. Additionally, a longitudinal slot 26 is formed within the tubular sleeve which is open at the first end 14 of the tubular sleeve 12 and terminates at a point adjacent the screw-threads 18 of the second end 16. At a position spaced apart from the longitudinal slot 26, there is formed a longitudinal protrusion on an inner surface of the tubular sleeve 12. The functioning of each of the longitudinal slot 26 and the longitudinal protrusion 28 will be more fully described below.

As shown most clearly in FIG. 2, a discharge nozzle 32 is constructed as a two-piece member including an applicator collar 22 and an integrally formed piece having a disc shaped base 30, a material distributor housing or head 33 and a hollow stem portion 34 connecting the base 30 and the distributor head 33. The disc 30 is formed of a soft rubber material in order to enhance sealing of the nozzle to the tubular sleeve 12. The collar 22 has an opening 36 formed therein through which the stem portion 34 is slidably received. It can be seen that the disc shaped base 30 is in fact a flange type arrangement at the base end of the hollow stem 34 and that the hollow stem graduates into the distributor portion 33 of the discharge nozzle 32. Since the stem 34 and the discharge nozzle 33 are of a hollow construction, dye or tinting material will be extruded therethrough for application to hair via the distributor portion 33 once the discharge nozzle is attached to the tubular sleeve. In particular, upon screwing the collar 22 to the second end 16 of the tubular sleeve 12, the flange or disc base 30 will be forced into sealing contact against an inner surface of the collar, such that the stem 34 and distributor portion 33 extend freely above the collar 22, thereby removing the sliding motion between parts of the discharge nozzle.

A piston 40 is provided to be slidably received within the tubular housing, reciprocation of the piston occurring in a longitudinal direction of the tubular sleeve. As most clearly shown in FIG. 2, the piston 40 includes a manual actuator button 42 and a longitudinally formed recess 44 on an exterior surface thereof. When the piston 40 is inserted into the tubular sleeve 12, the actuator button slidably fits within the longitudinal slot 26 while the longitudinal recess 44 of the piston 40 mates with the longitudinal protrusion 28 of the tubular sleeve 12. The engagement of the piston 40 with the tubular sleeve 12 as described, enables the piston 40 to longitudinally reciprocate within the tubular sleeve 12 without incurring axial rotation thereof. Accordingly, upon manual actuation of the piston 40 by pressing ones thumb against the actuator button 42, an easy sliding motion will be imparted to the piston without painful or annoying slippage of the thumb from the actuator button. Thus, an even, slow, smooth dispensing of material will occur at the discharge nozzle 32, due to increased control by the operator.

Figure 2B:
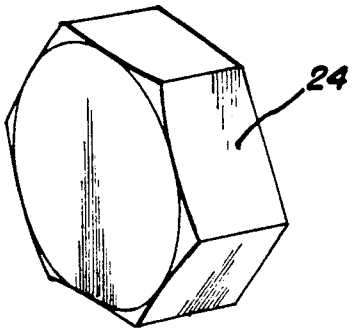
FIG. 2B is a perspective view of a mixing cap for use with the hair dye applicator of the present invention.

In order to eliminate messy cleanup and to ensure smooth operability of the sliding piston 40, the material such as dye or tint is completely contained within a disposable plastic liner or bag 38. This bag 38 is merely inserted into the second end 16 of the tubular sleeve 12 with enough overlap of the bag 38 to fold over the screw-threads 18 of the tubular sleeve. Upon attachment of the discharge nozzle 32 to the tubular sleeve 12, the bag 38 will be securely held in place. As shown in FIG. 2B, there is additionally provided a mixing cap 24 which is also machined to threadably engage with the second end 16 of the tubular sleeve 12. Use of the mixing cap 24 will enable the operator to mix and store dye and tint within the tubular sleeve 12 for an extended period of time without loss of the material therein.

An additional unique feature of the applicator device 10 is the parting wand holder 46 for selectively retaining a parting wand 48 therein. The parting wand holder 46 may either be integrally formed with or attached to the exterior of the tubular sleeve 12, and is of a shape and material to elastically clip the parting wand 48 therein. In order to provide an operator-friendly applicator, a parting wand holder 46 is formed on opposing sides of the tubular sleeve 12. Thus, the parting wand may be conveniently snap fitted into either of the parting wand holders 46 for easy access thereto, regardless of right or left hand use of the applicator 10 by an operator.

Figures 2A, 3, 4:
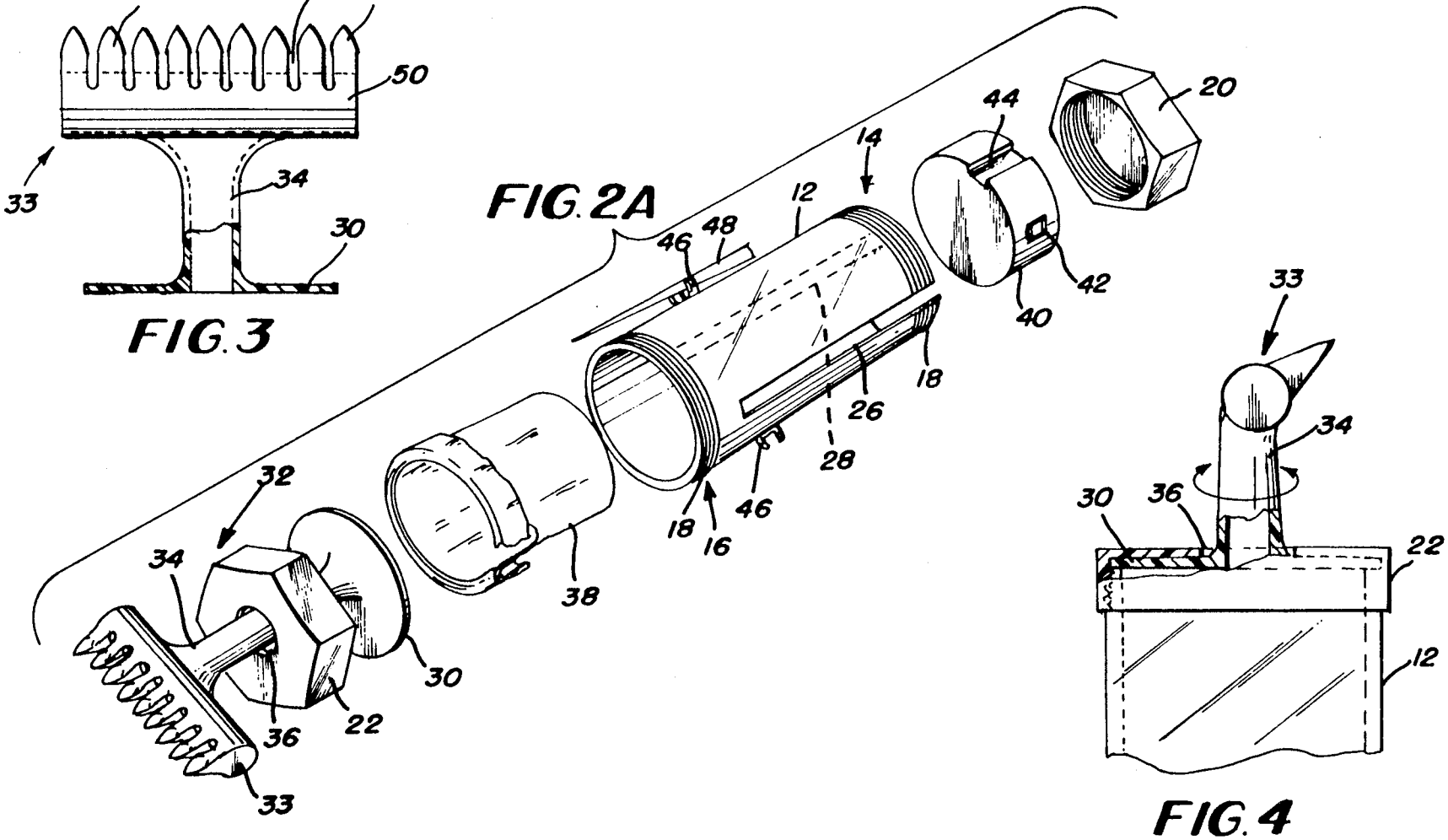
FIG. 2A is an exploded view of the hair dye applicator shown in FIG. 1.
FIG. 3 is an enlarged front view showing details of an applicator nozzle for use in the hair dye applicator of the present invention.
FIG. 4 is an enlarged side view of the applicator nozzle mounted to a body portion of the hair dye applicator of the present invention.

The discharge nozzle of FIG. 1 is shown enlarged in order to examine the detail thereof, the features of the distributor head 33 being further shown in detail in FIGS. 3 and 4. In particular, the distributor head 33 includes a tubular base portion 60 interrupted by a plurality of comb teeth bases 50 formed therein at predetermined intervals defined by a corresponding plurality of openings 54. Each of the bases 50 are provided with angular extensions 52 above the surface of the tubular base portion 60. Dye or tint material compressed within the disposable bag 38 is forced through the stem 34 into the distributor housing 33 and is dispensed at the plurality of openings 54. The purpose of the tooth extensions 52 is to maintain the application of dye a predetermined distance away from the scalp. A preferred height of the tooth extensions 52 is 5.0 mm, but may be preformed of various other heights, as the industry demands.

As shown primarily in FIG. 4, the distributor housing 33 is positioned at a predetermined angle with respect to the stem 34. Because of this unique feature, the discharge nozzle 32 can be comfortably adjusted to accommodate both left and right handed operators. By simply loosening the collar portion 22 and rotating the distributor head 33 to a desired orientation and tightening the collar back down against the tubular sleeve 12, virtually any orientation of the discharge nozzle 32 may be achieved.

Figure 5:
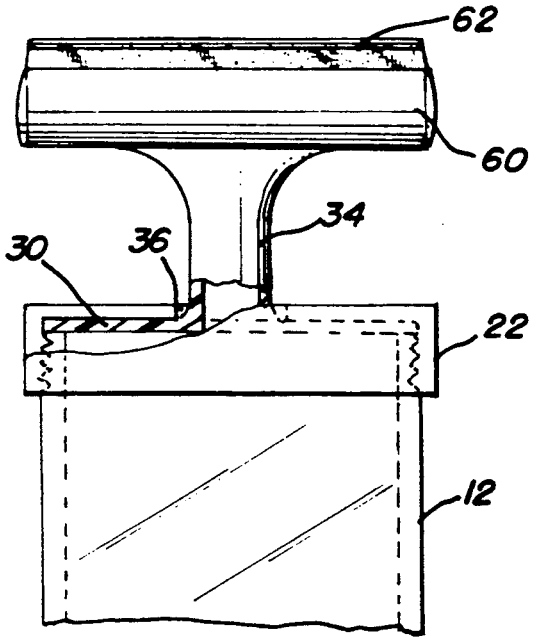
FIG. 5 is an enlarged front view of an alternative applicator nozzle for use with the hair dye applicator of the present invention.
Figure 6:
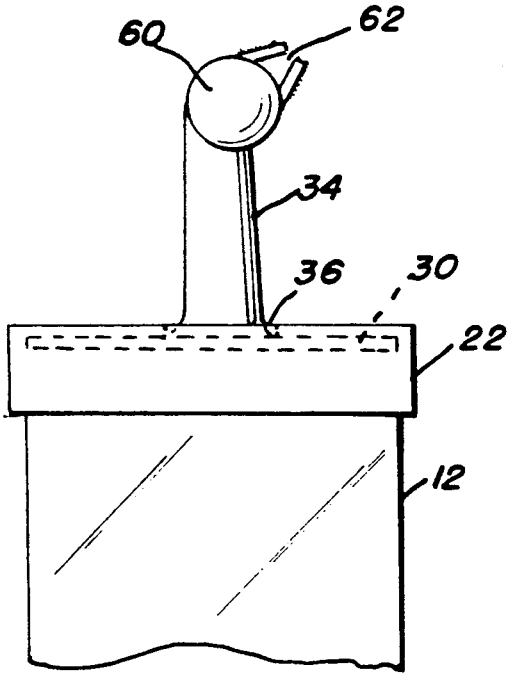
FIG. 6 is an enlarged side view of the alternative applicator nozzle shown in FIG. 5 attached to a body portion of the hair dye applicator of the present invention.

Referring now to FIGS. 5 and 6, there is shown a modification of the discharge nozzle portion of the applicator described above, whereby tinting of hair is performed.

All parts are identical to those described above with the exception of the distributor head and will not be renumbered or described again in connection with this embodiment.

The distributor head 33 includes a tubular base member 60 terminating in a longitudinally formed discharge opening 62. Adjacent each edge of the discharge opening 62, there is provided a nylon pad preferably 2 mm thick and 3.0 mm wide to enable an even distribution of tint mixture onto the hair strand. Similar to the dye distributor head described above, the tint distributor head 32 is mounted at a predetermined angle with respect to the stem portion 34 to facilitate use thereof in virtually any orientation by both left and right handed operators.

While the applicator device described above may be constructed of various shapes and sizes, the inventor has established preferred dimensions of selected parts thereof which particularly facilitate the dispensing of materials such as hair dye and hair tint which are mixed to desired consistencies and therefore require minimum opening dimensions to ensure a smooth, laminar flow and guarantee successful application of dye and tint to the hair.

For example, to enable the easy gripping of the tubular sleeve 12 by virtually any operator, the diameter thereof should be approximately 60.0 mm. The height of the piston 40 is 15.0 mm and the longitudinal slot 26 is 5.0 mm wide. The stem portion 34 of the discharge nozzle 32 is 10.0 mm in diameter and 25.0 mm in overall height. The diameter of the tubular base 60 of the distributor head 33 is 15.0 mm with the openings 54 thereof tapering from 3.0 mm at the base thereof to 1.5 mm adjacent the comb tooth extensions 52. Due to the differing consistency and reduced rate of application of the tint material, the tubular base 60 thereof is only 10.0 mm in diameter with the longitudinal opening having a 1.5 mm cross sectional dimension.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

I claim:

1. An applicator comprising:

a sleeve member of a hollow tubular construction having screw-threads on opposing open ends thereof;

an end cap threadably attachable to a first end of said sleeve member;

a discharge nozzle threadably attachable to a second end of said sleeve member;

a collapsible material receptacle removable fit within said sleeve member adjacent the second end thereof; and a cylinder shaped piston member slidable within said sleeve member;

wherein said piston member is manually actuable for compression against said material receptacle thereby extruding the contents of said material receptacle to said discharge nozzle;

said sleeve member including a longitudinally formed slot extending from the first end thereof to a position adjacent the second end thereof and a longitudinal rib formed on an inner surface thereof spaced a predetermined distance apart from said slot, and said piston member including an actuator member formed directly on an outer peripheral surface thereof and a longitudinal channel formed within the outer surface thereof such that said actuator member and said channel of said piston member mate, respectively, with said longitudinal slot and said longitudinal rib of said sleeve member, thereby avoiding twisting and bending of said piston member within said sleeve member upon manually sliding said piston member.

2. The applicator according to claim 1, wherein said discharge nozzle includes a collar threadably engageable with the second end of said sleeve member, said collar including an aperture formed therein, a disc shaped base sealingly engageable with an inner planar surface of said collar and including an inlet aperture formed therein, a distributor housing including a plurality of comb teeth and having discharge outlets formed between adjacent ones of the plurality of comb teeth, and a hollow stem portion integrally connecting said base and said distributor housing and reciprocally slidable within the aperture formed within said collar, said distributor housing being mounted at a predetermined angle to said hollow stem portion, whereby the threaded attachment of said collar to the second end of said sleeve member sealingly engages said base against an inner face of said collar and against an upper peripheral rim of said sleeve member in a selected one of a right-hand user direction and a left-hand user direction thereby orienting said distributor housing as determined by a right or left handed thumb actuation of said actuator member, respectively.

3. The applicator according to claim 1, further including at least one parting wand holder for removably retaining a parting wand against said sleeve member.

4. The applicator according to claim 3, wherein two parting wand holders are provided on diametrically opposing sides of said sleeve member to enable both left and right handed operation of the applicator free of interference from the parting wand.

5. The applicator according to claim 2, further including at least one parting wand holder for removably retaining a parting wand against said sleeve member.

6. The applicator according to claim 5, wherein two parting wand holders are provided on diametrically opposing sides of said sleeve member to enable both left and right handed operation of the applicator free of interference from the parting wand.

7. The applicator according to claim 1, wherein said discharge nozzle is rotatably attachable to said sleeve member to enable use of said applicator by both left and right handed operators.

8. The applicator according to claim 2, wherein said distributor housing includes means for applying material to hair at a predetermined distance away from a scalp.

9. The applicator according to claim 8, wherein said means includes a plurality of linearly spaced comb teeth formed within a tubular portion of said distributor housing and a corresponding plurality of tapered comb tooth ends extending a predetermined distance above each of said plurality of comb teeth respectively, whereby material is extruded from said distributor housing between each of said plurality of comb teeth and the material is applied to the hair at a distance from the scalp equal to a height of said plurality of tapered comb tooth ends.

10. The applicator according to claim 1, further including a threaded mixing cap removably attachable to the second end of said sleeve member for retaining material within said collapsible material receptacle when the material stored therein is either not in use or being agitated for future use.

11. The applicator according to claim 1, wherein said discharge nozzle includes a collar threadably engageable with the second end of said sleeve member, said collar including an aperture formed therein, a disc shaped base sealingly engageable with an inner planar surface of said collar and including an inlet aperture formed therein, a distributor housing having a longitudinally formed discharge outlet therein, application pads externally mounted parallel to each other on said distributor housing adjacent said discharge outlet, and a hollow stem portion integrally connecting said base and said distributor housing and reciprocally slidable within the aperture of said collar, whereby the threaded attachment of said collar to the second end of said sleeve member sealingly engages said base portion against an inner face of said collar and against an upper peripheral rim of said sleeve member.

12. The applicator according to claim 11, further including at least one parting wand holder for selectively retaining a parting wand against said sleeve member.

13. The applicator according to claim 12, wherein two parting wand holders are provided on each sleeve member on diametrically opposing sides thereof to enable access by both left and right handed applicator operators.

14. The applicator according to claim 11, wherein said discharge nozzle is rotatably attachable to said sleeve member to enable operation of said applicator by both left and right handed operators.

15. The applicator according to claim 11, wherein said distributor housing is mounted at a predetermined angle to said hollow stem portion and said nozzle is rotatably attachable to said sleeve member thereby orientating the longitudinally formed discharge opening in a predetermined direction as determined by a selected one of a left and right handed thumb actuation of said actuator member to enable operation of said applicator by both left and right handed operators, respectively.

16. A hair dye applicator comprising:

a sleeve member of a hollow tubular construction having screw-threads on opposing open ends thereof;

an end cap threadably attachable to a first end of said sleeve member;

an applicator collar screw threadably attachable to a second end of said sleeve member, said applicator collar including an opening formed in a substantially centered area thereof;

an applicator member slidably fitted within the opening of said applicator collar, said applicator member including a disc shaped base having an inlet formed therein and sealingly engageable with an inner portion of said applicator collar, an applicator nozzle positioned exterior to said applicator collar, and a hollow shaft integrally connecting the inlet of said base and said applicator nozzle, said shaft being slidable within the opening of said applicator collar;

a collapsible hair dye receptacle removably fit within said sleeve member adjacent said second end thereof; and a piston member slidable within said sleeve member, said piston member being manually actuable for compressing the contents of said collapsible hair dye receptacle thereby extruding hair dye from said receptacle into the inlet of said base and out of said applicator nozzle;

wherein said sleeve member includes a longitudinally formed slot extending from the first end thereof to a position beneath the screw threads on the second end thereof and a longitudinal rib formed on an inner surface thereof spaced a predetermined distance apart from said slot, and wherein said piston member includes an actuator member formed on an outer peripheral surface thereof and a longitudinal recess formed on the outer surface thereof such that said actuator member and said recess of said piston member mate, respectively, with said longitudinal slot and said longitudinal rib of said sleeve member, thereby avoiding twisting and bending of said piston member within said sleeve member upon sliding actuation of said actuator member; and wherein in an assembled state, said hair dye applicator provides a composite unit easily operable with one hand.

17. A combined material mixing and applicator device comprising:

a sleeve member of a hollow tubular construction and having screw-threads on opposing open ends thereof;

a first end cap threadably attachable to a first end of said sleeve member;

a discharge nozzle threadably attachable to a second end of said sleeve member;

a second end cap threadably attachable to the second end of said sleeve member;

a collapsible material receptacle removably fit within said sleeve member, the collapsible material receptacle being closed adjacent the first end of said sleeve member and open at the second end thereof; and a cylinder shaped piston member slidable within said sleeve member against the closed end of said collapsible material receptacle;

wherein said second end cap is selectively replaceable with said discharge nozzle according to a function of said device as a material mixer or material applicator, respectively.

18. The combined material mixer and applicator device according to claim 17, wherein said sleeve member includes a longitudinally formed slot extending from the first end thereof to a position adjacent the second end thereof and a longitudinal rib formed on an inner surface thereof spaced a predetermined distance apart from said slot, and said piston member is cylinder shaped and includes an actuator member formed directly on an outer peripheral surface thereof and a longitudinal channel formed within the outer surface thereof such that said actuator member and said piston mate, respectively, with said longitudinal slot and said longitudinal rib of said sleeve member, thereby avoiding rotation of said piston member within said sleeve member upon manual actuation of said piston member.

19. The combined material mixer and applicator device according to claim 17, wherein said discharge nozzle includes a distributor head mounted at a predetermined offset angle with respect to a longitudinal axis of said sleeve member, said discharge nozzle being rotatably attachable to said sleeve member for orienting said distributor head in a selected one of a right-handed and left-handed user direction according to a right or left handed thumb actuation of an actuator member, respectively.

20. The combined material mixer and applicator device according to claim 17, further including two parting wand holders provided on diametrically opposing sides of said sleeve member for removably retaining at least one parting wand thereagainst to enable both right and left handed operation of the combined mixer and applicator device free of interference from the at least one parting wand.

21. The combined material mixer and applicator device according to claim 19 wherein said distributor head includes a linear discharge outlet formed in a longitudinal surface thereof and parallel applicator pads externally mounted on said distributor head immediately adjacent to and coextensive with said linear discharge outlet.

22. The combined material mixer and applicator device according to claim 19, wherein said distributor head includes a plurality of linearly spaced comb teeth formed therein, and a corresponding plurality of tapered comb tooth ends extending a predetermined distance above each of said plurality of comb teeth, respectively, whereby material is extruded from said distributor head between each of said plurality of comb teeth and the material is applied to the hair at a distance from the scalp equal to a height of said plurality of tapered comb tooth ends.

23. The combined material mixer and applicator device according to claim 17, wherein each of said sleeve member, first end cap, discharge nozzle, second end cap, collapsible material receptacle, and cylinder shaped piston member are formed of non-reactive materials.

* * * * *